United States Patent [19]

Shulz

[11] Patent Number: 4,729,873

[45] Date of Patent: Mar. 8, 1988

[54] PROCESS AND APPARATUS FOR PRODUCING STEEL

[75] Inventor: Jorge U. Shulz, Santiage de Chile, Chile

[73] Assignee: Compania de Acero del Pacifico S.A. de

[21] Appl. No.: 865,019

[22] Filed: May 20, 1986

[30] Foreign Application Priority Data

May 20, 1985 [DE] Fed. Rep. of Germany ..... 3518023

[51] Int. Cl.[4] ..... C21C 33/00

[52] U.S. Cl. ..... 420/129

[58] Field of Search ..... 420/129

[56] References Cited

U.S. PATENT DOCUMENTS

| | | | |
|---|---|---|---|
| 3,305,923 | 2/1967 | Zimmer | 29/528 |
| 3,905,803 | 9/1975 | Bianchi | 75/10 R |
| 4,396,425 | 8/1983 | Faulring | 420/129 |

*Primary Examiner*—Peter D. Rosenberg

*Attorney, Agent, or Firm*—Antonelli, Terry & Wands

[57] ABSTRACT

A process and apparatus for the production of materials such as steel, in which the different components are "interwoven" in such a manner that solid state materials are fed into a matrix, which is still in a liquid state for casting and that the mix, respectively, the conglomerate, formed in this manner, is made to freeze or stabilize and, afterwards, the cast structure is processed by conversion and/or heat treatment. In this manner, it is possible to, for example, store particularly hard, i.e., extremely hard ingredients as those used, for example, in the hardest armoured steel, in the form of particles, that is solid bodies in a softer, tougher matrix. In this manner, on the one hand, the welding ability of the composite can be substantially improved and, on the other hand, it is possible to exclude the otherwise common cracking sensitivity of particularly hard special steels because the softer, tougher matrix prevents the expansion of the crack in the structure.

24 Claims, 6 Drawing Figures

Fig. 3
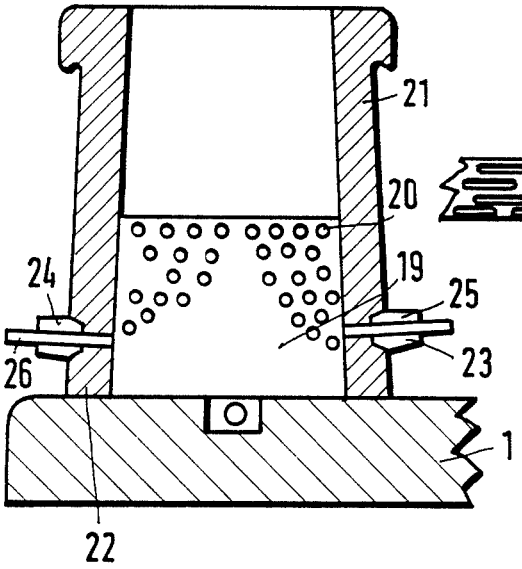
Fig. 5
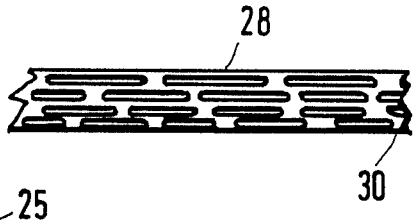
Fig. 6
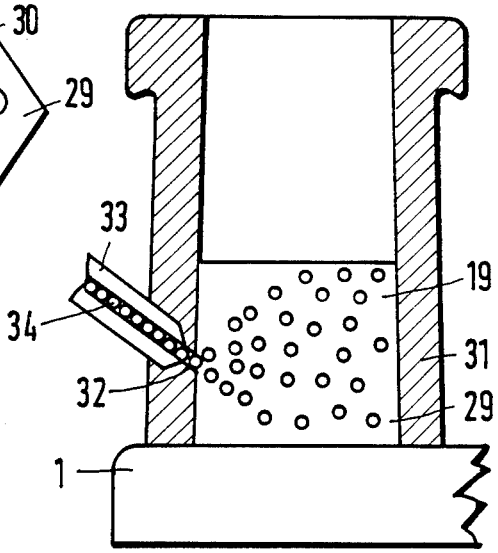
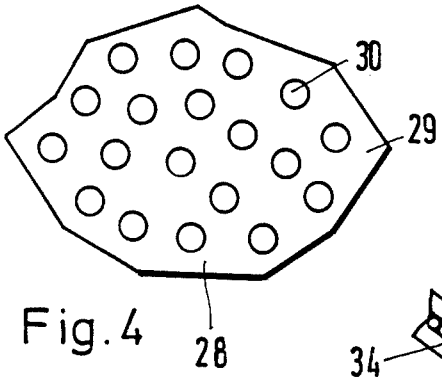
Fig. 4

PROCESS AND APPARATUS FOR PRODUCING STEEL

BACKGROUND OF THE INVENTION

The present invention relates to a process and apparatus for producing steel by joining different components or different grades of steel.

Centuries ago, in the Near East, blades for knives and swords with amazing properties such as, for example, so-called damascene swords, were manufactured. The success and fame of these blades was not as a result of the patterned appearance but rather of their properties inasmuch as the swords combined the greatest hardness with a high degree of toughness thereby making them unsurpassable as steel for tools and arms. Damascene swords apparently supposedly consisted of two different steels, one of which had a greater hardness, and the other a better toughness with both steel components being elaborately "interwoven" or closely joined with one another.

Centuries ago the art of manufacturing damascene swords was lost; however, even if such art could be known again, the process then in use could not be applied for industrial production today and, consequently, would be of no economic value.

During the last century, there was a similar material developed, a so-called puddled steel which also exhibited excellent properties for blades of knives and arms. However, metalurgists today consider the steel as being disadventageous because it is interspersed with slags in a very irregular manner. However, such blades for knives and arms also had excellent cutting ability and those who may still possess knives made from a puddled steel except the endless cleaning rather than exchange these knives having excellent cutting abilities, for modern knives, i.e., knives with stainless steel blades.

The present invention essentially resides in providing a process and apparatus for a production of steel by joining different components, i.e., different grades of steel and/or alloying constituants so that steel with never changing properties and optimum toughness having an excellent hardness can be industrially manufactured.

In accordance with advantageous features of the process of the present invention, one or several solid state materials or components are fed into a liquid melt consisting essentially of one or more components, with the solid state material or materials being only melted on a near surface but not melted open in the temperature of the liquid melt which is preferably only slightly higher than the temperature of the liquidus, and with the material produced in such a manner being made to freeze or solidify and undergo subsequent conversion and, if necessary, heat treatment.

In accordance with further advantageous features of the process of the present invention, the casting temperature is that much above the otherwise common temperature that the quantity of heat of the liquid melt to respectively melt the solid state material. Advantageously, the solid components may be blown into the melt with the blowing-in being effected by an inert gas as a carrier gas such as, for example, argon.

It is also possible in accordance with the present invention for the blowing-in of the solid material ingredients to be carried out by means of an active gas such as, for example, nitrogen or carbon monoxide, or by a mixed gas.

The solid component or solid components may, in accordance with the present invention, be pressed into the liquid melt and the solid material ingredients may be fed in the form of granulates or balls into the liquid melt.

Moreover, according to the process of the present invention, the solid material ingredients may be spooled into the liquid melt in the form of wires and, the solid component or solid components may be preheated.

Also, the carrier gas may also be preheated prior to blowing the same into the liquid melt and solid components of different complimentary materials are fed into the liquid melt. It is also possible for the material ingredients of different grain size to be fed into the liquid melt and, advantageously, gravity die temperature may be increased above normal.

Advantageously, in accordance with further features of the process of the present invention, the following typical combinations of material for steel may be provided:

| component | C | Si | Mn | Cr | Ni | Mo | Nb | B |
|---|---|---|---|---|---|---|---|---|
| A | .05 | .10 | .40 | — | 0.40 | — | — | — |
| | .25 | .40 | 1.80 | — | 1.80 | — | — | — |
| B | .80 | .40 | .40 | .40 | max | .20 | .004 | max |
| | .80 | .40 | 1.00 | 2.00 | 2.00 | 1.00 | 0.30 | .005 |

Advantageously, the material is subjected to a heat treatment of Austenitizing at 880° up to 960° C., chilling in air, oil or water, tempering at temperatures between 160° and 720° C.

In order to achieve a better conductive discharge of the carrier gas, advantageously the head of the ingot is heated.

The grain size of the fed solid state materials is between 1 and 15 mm and, preferably, between 3 and 8 mm. In the process of the present invention the solid state materials, especially the granulates fed into the liquid melt, have a predetermined shape of, for example, a lenticular or long grain shape.

Additionally, the process of the present invention is characterized by the fact that the solid state materials stored during the liquid phase, granulates in particular, as a result of specific measures, show different forms of distribution.

By using the process of the present invention, it is possible to achieve an industrial production of steel which with extreme hardness has a high degree of toughness so as to exhibit the stunning properties of presumably one would have called a "damascene" steel.

Moreover, the process of the present invention makes it possible to "interweave", that is, to closely join one or more components in such a manner that the above-noted excellent properties of the steel can be obtained.

Additionally, with the process of the present invention, the different components are joined at a moment at which one of the component or components is or respectively are still liquid, while the other component or components is or are in a solid state. The result of this is that the particles of the solid component or solid components completely melt on but do not completely melt open. After a freezing or solidifying of the material, a composite structure is formed which has a matrix consisting of the cast steel and embeds numerous metallic segregates from the other component or other components fed in solid form.

If a steel produced by the process of the present invention is rolled out as a slab or the like, the embedded segregates take lamellar shape or the like which means that the combination of a single component becomes even more intimate and, optimal properties can be obtained by a following quenching and tempering treatment which, however, according to the present invention, is not necessary.

By using the process of the present invention, composite steel can be produced which distinguishes itself by its combination of a high degree of firmness and toughness which cannot otherwise be obtained.

Moreover, the welding ability of the steel according to the present invention is substantially better than can be expected because of the high degree of firmness and the cracking resistance is so great that the incipient cracks forming in the hard particles do not continue in the softer matrix but are caught or trapped in it, and this also applies for the formation of cracks induced by hydrogen.

With the process of the present invention, two steels of a great hardness and toughness can be produced and, moreover, the use of the process of the present invention allows the industrial production of materials with special chemical properties as well as industrial production of materials with special wear resistance.

Additionally, no difficulties arise from the industrial production of materials with special magnetic properties with the process of the present invention and, the process of the present invention allows the production of steel which is suitable for military purposes such as, for example, armoured steel.

Furthermore, the process of the present invention permits the production of special cutters or a material with special electrical properties.

By virtue of the fact that the casting temperature is that much above the otherwise common temperature than the quantities of heat of the liquid melt are sufficient to melt on the solid state materials, the quantities of heat from the melt are sufficient to melt on the component or the respective particles.

Additionally, the present invention enables the blowing-in of, for example, the solid state materials into the gravity die or into a steel pouring ladle or into a pouring stream.

Moreover, by employing an inert carrier gas such as, for example, argon, such carrier gas does not change the composition of the liquid material although it is possible to blow in the solid state materials by means of an active gas.

It is also possible in accordance with the present invention to do without carrier gas completely, i.e., if the solid state materials are pressed into the melt.

Likewise, when solid state materials are fed into the melt or in the form granulate or balls, the balls or granulates can be pressed or otherwise brought into the melt through pipes, conduits, and/or borings, with the balls and/or granulates being distributed in the melt by a casting turbulence.

With large quantities of the fed solid, the cooling effect can become so great that, in compensation, the solid state materials and/or the carrier gas as well may be preheated. The freezing or solidifying in the gravity die or the like usually starts from the place of the greater cooling, that is, the side wall of the gravity die and, in the present case, this is supported by the injected solid components, for example, granulate particles thereby altering the cooling conditions.

By mixing several solid state materials such as, for example, granulates, with each other it is possible to cause different properties in the composite homogeneous to the outside and produced with the process according to the present invention.

Different degrees of melting on of the particles may be obtained by providing different grain size components into the liquid melt thereby resulting in a change in the corresponding properties in the finished material.

If, prior to the end of the blowing-in operation or phase, a lid is already formed in the head of the slab of the respective ingots, there is the danger that the blow-in gas cannot escape anymore and form bubbles in the ingot. This premature "freezing" can be counteracted by appropriate measures such as, for example, the use of exothermal or insulating pouring powders or of a heating device for heating the head of the ingot.

The grain size of the solid state materials fed into the melt depends, among other things, upon the available heat content. On the one hand, the injected particles must be completely melted on or welded on to the surface and, on the other hand, they must not completely dissolve while being in the liquid melt. Finally, later in the solid phase, they must not dissolve by diffusion either. The optimal particle size has to be established by test and, therefore, the particles size of between 1 and 15 mm and, preferably between 3 and 8 mm, represent indication of examples for preferential ranges according to the present invention. The solid state materials in the process of the present invention may have shapes that differ from a ball shape and may be formed such as, for example, cut steel shot.

In the edges of the gravity dies, the part of the sheets that that latter will be near the surface, an accumulation of solid particles is desirable and should be caused and this may be achieved, above all, by an appropriate heat conduction of the side wall of the gravity die, a so called fly-paper effect.

In accordance with advantageous features of the apparatus of the present invention, at least one group-teeming bottom plate is provided along with at least one gravity die mounted in an upright position and connected by a channel to a funnel. The group-teeming bottom plate, a channel or several such channels debouch from beneath into the relevant gravity die, and a carrier gas source is provided for feeding a mixture of a carrier gas and solid state materials is joined to the relevant channel and/or in the side wall of the gravity die, at least one boring is made which is joined to a pipe connected to the same or another carrier gas source to feed a mixture of carrier gas and solid state material parts and/or relevant boring is connected with an appropriate conveying device for pressing-in of the solid state material ingredients.

The solid state material ingredients may be fed, in accordance with the apparatus of the present invention, by means of a lance with a fireproof coating to the pouring ladle or during the casting process to a mold or into the pouring stream. By virtue of the features of the apparatus of the present invention, it is possible to feed the solid state materials into the liquid melt and into a gravity die, into a steel pouring ladle or into the pouring stream.

By virtue of the provisions of a lance with a fireproof coating, it is possible to feed the granulates or the like into, for example, a steel pouring ladle, or during the casting process, into a mold. For the blowing-in into a pouring ladle, the granulates or the like will have to be substantially coarser. Due to the longer dwell time in the liquid phase, a greater part of the particles being melted open from the direction of the edges cannot be avoided here.

FIG. 3 is a partial cross-sectional view of another embodiment of the apparatus constructed in accordance with the present invention;

FIG. 4 is an enlarged detailed view of a cast structure produced by the process and apparatus of the present invention;

FIG. 5 is a top sector-shaped view of the cast structure of FIG. 4 after a rolling operation; and, FIG. 6 is a partial cross-sectional view of yet another embodiment of an apparatus constructed in accordance with the present invention.

DETAILED DESCRIPTION

Figure 1:
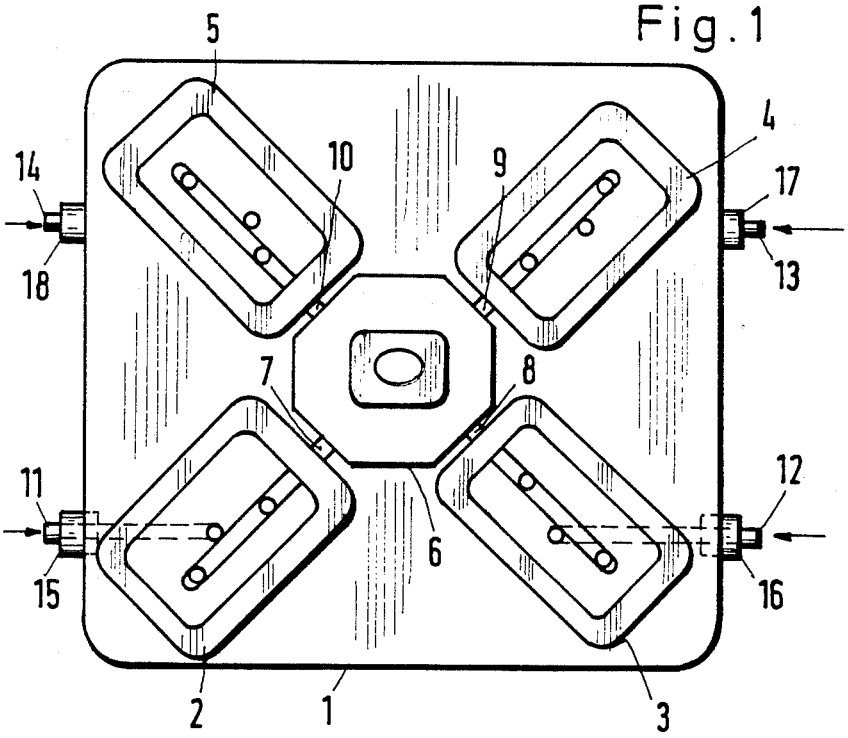
FIG. 1 is a horizontal projection of an apparatus for producing, for example, steel, constructed in accordance with the present invention.
Figure 2:
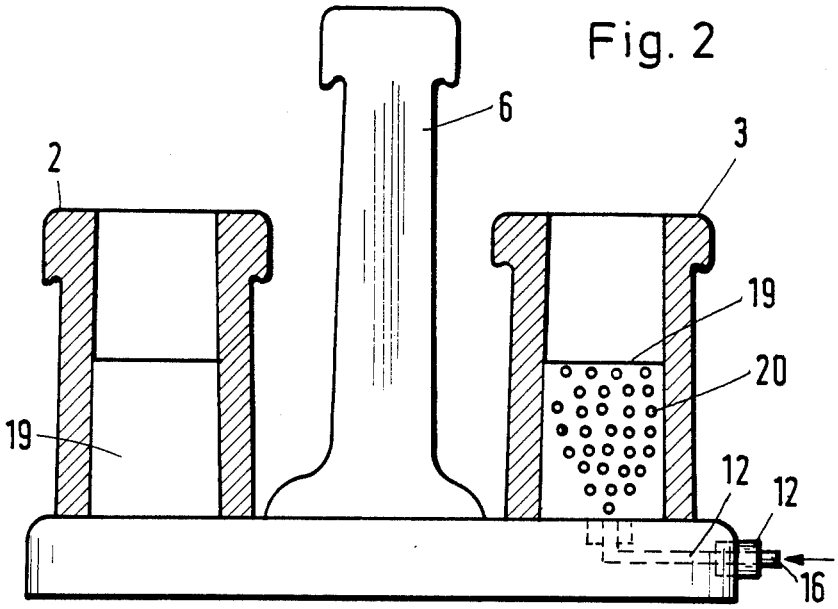
FIG. 2 is a cross-sectional view of the apparatus of FIG. 1.

Referring now to the drawings wherein like reference numerals are used throughout the various views to designate like parts and, more particularly, to FIGS. 1 and 2, according to these figures, an apparatus for producing, for example, steel, includes a so called group-teeming bottom plate 1 upon which is vertically mounted four gravity dies 2–5. A funnel 6 is in melt conducting connection, through channels 7, 8, 9, and 10, with the gravity dies 2–5 in such a manner that each of the gravity dies 2–5 is in a melt conducting connection with the funnel 6 through one of the channels 7–10 at a time. Each of the gravity dies 2–5 is respectively in gas conducting connection with carrier gas channels 11, 12, 13, 14, one at a time. Connection nipples 15, 16, 17, 18, respectively detachably and gastightly connect tubes or pipes (not shown), through which a carrier gas such as, for example, an inert gas such as argon, is delivered from beneath into the respective gravity dies in such a manner that the carrier gas in the liquid melt 19 (FIG. 2) rises from the bottom of the gravity dies 2–5 and escapes towards the top.

In the illustrated apparatus of FIGS. 1 and 2, and appropriate component or several components of another material such as, for example, particularly hard steel such as armoured steel, are added to the carrier gas in the form of granulates which distributes through the swirling in the liquid melt 19 as gramatically illustrated in FIG. 2 by the reference numeral 20. When a freezing or solidification occurs, these particularly hard particles are embedded in a soft, tough matrix.

As shown in FIGS. 1 and 2, the carrier gas channels 11–14 extend or run into the group-teeming bottom plate 1; however, as can readily be appreciated, the carrier gas channels may, for example, be installed on the group-teeming bottom plate 1 in the form of protected pipes or the like.

In the apparatus of FIG. 3, several gravity dies 21 can be mounted on one or several group-teeming bottom plates 1, although only one gravity die 21 is depicted for the sake of clarity. In the arrangement of FIG. 3, the solid state materials 20 are blown into the liquid melt 19 through a plurality of borings distributed over a circumference or range of the gravity die by a carrier gas such as, for example, argon. In FIG. 3, only two borings, 22, 23, are illustrated, each one of which is associated with a connection nipple 24, 25, through which one of the pipes, 26, 27, in a carrier-gastight manner. In this manner, the blowing-in of the solid state materials 20 is not carried out immediately from the bottom anymore but at a distance from the bottom of the gravity die 21. In the illustrated embodiment of FIG. 3, the borings 22, 23 are disposed in the gravity die 21 at about one-third a height of the melt; however, as can readily be appreciated, depending on the nature of the melt, other height dimensions may be chosen and, consequently, the subject matter of the present invention is not limited to the specific number of borings 22, 23 nor to the represented height dimensions.

As shown in FIG. 4, a cast structure produced by the apparatus in process of the present invention shows an evenly distributed particularly hard particles 30 embedded in a relatively soft tough matrix 29 which exhibits or has the properties of the best armoured steel.

FIG. 5 illustrates the cast structure after rolling where the composite from the matrix material 29 and embedded granulate material 30 has changed its shape through specific heat and/or cold forming, with the particularly hard particles 30 being reshaped in a long or lengthened form.

From the embodiments shown in FIG. 6, while only one gravity die 31 is illustrated, it is understood that a plurality of such gravity dies may be provided in which the liquid melt 19 is set. The plurality of gravity dies 31 are mounted on a group-teeming bottom plate 1 or the like, with the number of gravity dies 31 being determined by the specific processing operation. As shown in the illustrated gravity die 31, a lateral boring 32 is provided with a connection channel 33 through which particularly hard particles 34 are pressed into the liquid melt 19 in the form of balls and, thus, the particularly hard particles 34 are distributed in the liquid melt through a casting turbulence and, when freezing or solidifying, form a cast structure of touch matrix 29 and particularly hard particles 35 which, in its turn, is brought into the respective desired shape, for example, sheets, by specific heat treatment and/or reshaping.

While I have shown and described several embodiments in accordance with the present invention, it is understood that the same is not limited thereto but is acceptable to numerous changed and modifications as known to one having ordinary skill in the art, and I therefore do not wish to be limited to the details shown and described herein, but intend to cover all such modifications as are encompassed by the scope of the appended claims.

I claim:

1. A process for producing steel by joining different components, comprising:

providing a liquid melt consisting essentially of at least one grade of steel;

feeding at least one solid state material into said liquid melt; and solidifying the material produced;

wherein said solid state material is adapted to melt on a near-surface but not open melt at a predetermined temperature just above the temperature of liquidus of said liquid melt.

2. A process according to claims 1, further comprising:

after the steps of solidifying, conversion of the material produced.

3. A process according to claims 1, further comprising:

after the steps of solidifying, heat treating the material produced.

4. A process according to claims 1, further comprising:

blowing said at least one solid state material into said liquid melt.

5. A process according to claim 4, wherein said step of blowing includes supplying a carrier gas.

6. A process according to claim 5, wherein said carrier gas is argon.

7. A process according to claim 4, wherein said step of blowing includes supplying an active gas.

8. A process according to claim 7, wherein said active gas is selected from the group consisting of nitrogen, carbon monoxide and a mixed gas.

9. A process according to claims 1, further comprising:

pressing said at least one solid state material into said liquid melt.

10. A process according to claim 1, wherein said at least one solid state material is fed in a form of at least one of granulates or balls.

11. A process according to claim 10, wherein said at least one solid state material is in the form of granulates and has a predetermined shape of at least one lenticular or long grain.

12. A process according to claim 1, wherein said at least one solid state material is spooled into said liquid melt in the form of wires.

13. A process according to claim 12, wherein said at least one solid state material is preheated.

14. A process according to claim 5, wherein said carrier gas is preheated.

15. A process according to claim 7, wherein said active gas is preheated.

16. A process according to claim 1, wherein said at least one solid state material is composed of different complimentary materials.

17. A process according to claim 16, wherein said complimentary materials have different grain sizes.

18. A process according to claim 1, wherein said providing comprises providing said liquid melt in a gravity die and further comprises increasing a temperature of said gravity die above said temperature of liquidus of said at least one predetermined component.

19. A process according to claim 1, wherein said at least one solid state material consists essentially of:

| component | C | Si | Mn | Cr | Ni | Mo | Nb | B |
|---|---|---|---|---|---|---|---|---|
| A | .05 | .10 | .40 | — | 0.40 | — | — | — |
| | .25 | .40 | 1.80 | — | 1.80 | — | — | — |
| B | .20 | .10 | .40 | .40 | max | .20 | .004 | max |
| | .80 | .40 | 1.00 | 2.00 | 2.00 | 1.00 | .30 | .005 |

20. A process according to claim 1, further comprising pretreating said at least one solid state material.

21. A process according to claim 20, wherein said pretreating comprises:

austenitizing at a temperature between 880°-960° C.;

chilling in at least one of air, oil or water; and tempering at a temperature between 160°-720° C.

22. A process according to claim 1, wherein said at least one solid state material has a grain size between 1-15 mm.

23. A process according to claim 22, wherein said grain size is between 3-8 mm.

24. A process according to claim 1, wherein said at least one solid state material exhibit different forms of distribution within said liquid melt.

* * * * *